US009676194B2

(12) United States Patent
Okushima et al.

(10) Patent No.: US 9,676,194 B2
(45) Date of Patent: Jun. 13, 2017

(54) INKJET PRINTING METHOD AND INKJET PRINTING APPARATUS

(71) Applicant: SCREEN Holdings Co., Ltd., Kyoto (JP)

(72) Inventors: Tomoyasu Okushima, Kyoto (JP); Seiya Nomura, Kyoto (JP); Susumu Takahashi, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 0 days.

(21) Appl. No.: 14/845,915

(22) Filed: Sep. 4, 2015

(65) Prior Publication Data

US 2016/0075139 A1 Mar. 17, 2016

(30) Foreign Application Priority Data

Sep. 11, 2014 (JP) ..... 2014-185526
Sep. 12, 2014 (JP) ..... 2014-186573
Jul. 27, 2015 (JP) ..... 2015-148048

(51) Int. Cl.
*B41J 2/165* (2006.01)
*B41J 2/205* (2006.01)

(52) U.S. Cl.
CPC ..... *B41J 2/16526* (2013.01); *B41J 2/16585* (2013.01); *B41J 2/2054* (2013.01); *B41J 2002/16529* (2013.01)

(58) Field of Classification Search
CPC ..... B41J 2/165; B41J 2/16526; B41J 2/2054; B41J 2/16585; B41J 2002/16529
See application file for complete search history.

(56) References Cited

U.S. PATENT DOCUMENTS

2005/0212851 A1 9/2005 Akase et al. ..... 347/40
2005/0285894 A1* 12/2005 Nakayama ..... B41J 13/0027 347/35

FOREIGN PATENT DOCUMENTS

JP 09183233 A * 7/1997
JP 2002-225305 8/2002
JP 2005-262551 9/2005

* cited by examiner

*Primary Examiner* — Alessandro Amari
*Assistant Examiner* — Roger W Pisha, II
(74) *Attorney, Agent, or Firm* — Ostrolenk Faber LLP

(57) ABSTRACT

A controller controls printing heads to print a page information mark with black ink to perform line flushing. The printing heads each have a plurality of inkjet nozzles for discharging ink being disposed in parallel in a width direction of web paper. Upon printing the mark, when an overlap region is present in which a mark printable region overlaps a line flushing region with ink other than the black ink, the controller performs control to decrease an ink discharge amount per unit area in the overlap region in the mark printable region to be smaller than that in the mark printable region except for the overlap region and the line flushing region. This causes a decreased total ink discharge amount in the overlap region.

6 Claims, 10 Drawing Sheets

INKJET PRINTING METHOD AND INKJET PRINTING APPARATUS

CROSS-REFERENCE TO RELATED APPLICATIONS

This application claims priority to Japanese Patent Application No. 2014-185526 filed Sep. 11, 2014, Japanese Patent Application No. 2014-186573 filed Sep. 12, 2014, and Japanese Patent Application No. 2015-148048 filed Jul. 27, 2015, the subject matter of which is incorporated herein by reference in entirety.

TECHNICAL FIELD

The present invention relates to an inkjet printing method and an inkjet printing apparatus that discharge ink (ink droplets) to a print medium to be transported for printing images. More particularly, the present invention is directed to a technique of line flushing to avoid clogging.

BACKGROUND ART

An inkjet printing apparatus includes a transport mechanism transporting web paper (a print medium), and printing heads each discharging ink to the web paper to be transported. The inkjet printing apparatus performs line flushing periodically at a position of an ink receiver to avoid clogging. In the line flushing, all nozzles of the printing heads discharge ink. See, for example, Japanese Unexamined Patent Publications No. 2002-225305A and 2005-262551A. The line flushing is performed to a non-printable region between printable regions of image data represented by characters, figures, and pictures. The non-printable region is not used as a printable region of the image data.

SUMMARY OF INVENTION

Technical Problem

However, the example of the currently-used apparatus with such a configuration above has the following problems. Specifically, the inkjet printing apparatus performs the line flushing to the web paper to be transported. Upon this, ink adhered on the web paper bleeds. Such a problem arises about poor ink drying characteristics. Correspondingly, transfer of the adhered ink to another portion or show-through of the adhered ink may be generated. Such another problem arises. As a result, it is required to enhance drying characteristics of ink adhered by the line flushing.

Moreover, as illustrated in FIG. 1A, the line flushing is performed to a page top position TP as the non-printable region while a printing start mark MA1 is printed onto the page top position TP. This causes an overlap region K1 of the printing start mark MA1 and line flushing regions C, M, and Y. Consequently a total ink discharge amount (total ink adhesion amount) per unit area in the overlap region K1 increases, leading to much poor ink drying characteristics. Such another problem arises.

The following describes in detail a reason why the overlap region K1 is generated. The printing start mark MA1 is used for determining a timing of starting printing onto a rear face of the web paper. The printing start mark MA1 is preferably printed onto the page top position TP. The line flushing is performed over a width direction 202 of the web paper WP while all nozzles of the printing heads discharge ink. See FIG. 1B. Consequently, it is impossible to perform the line flushing except for the printing start mark MA1. In addition, if printing of the printing start mark MA1 as well as the line flushing is performed to a region shifted in a transportation direction 201 of the web paper WP, the non-printable region becomes larger. This causes unnecessary consumption of the web paper WP and thus causes a smaller printable region for the image data.

Consequently, a total ink discharge amount (total ink adhesion amount) per unit area in the overlap region K1 increases, leading to poor ink drying characteristics. This results in transfer to another portion or show-through of the adhered ink. Such a problem arises.

The present invention has been made regarding the state of the art noted above, and its one object is to provide an inkjet printing method and an inkjet printing apparatus each allowing enhanced drying characteristics of adhered ink.

Solution to Problem

The present invention is constituted as stated below to achieve the above object. One embodiment of the present invention discloses an inkjet printing method of printing an image by controlling printing heads with a controller to discharge ink to a print medium to be transported, the printing heads having a plurality of inkjet nozzles for discharging the ink being disposed in parallel in a width direction intersecting a transportation direction of the print medium. The inkjet printing method includes a mark printing step of printing a page information mark onto the print medium with pre-set color ink, the page information mark representing page information on the print medium; and a line flushing step of performing line flushing to the print medium in which all of the inkjet nozzles associated with printing of the image discharge the ink individually along with the mark printing step of printing the page information mark. Upon printing of the page information mark, when an overlap region is present in which a printable region of the page information mark with the pre-set color ink overlaps a line flushing region with ink other than the pre-set color ink, the mark printing step includes a decreasing step of decreasing an ink discharge amount per unit area in the overlap region in the printable region of the page information mark to be smaller than that in the printable region of the page information mark except for the overlap region and the line flushing region.

With the inkjet printing method according to one embodiment of the present invention, the printing heads each include a plurality of inkjet nozzles for discharging ink, the inkjet nozzles being arranged in parallel in the width direction of the print medium intersecting the transportation direction of the print medium. The controller controls the printing heads to print the page information mark, representing the page information on the print medium, with the pre-set color ink, and to perform the line flushing. Upon printing of the page information mark, when the overlap region is present in which the printable region of the page mark information overlaps the line flushing region with ink other than the pre-set color ink, the controller performs control to decrease the ink discharge amount per unit area in the printable region of the page information mark to be smaller than that in the printable region of the page information mark except for the overlap region and the line flushing region. Consequently, a total ink discharge amount in the overlap region is decreased, allowing enhanced ink drying characteristics.

In addition, the ink discharge amount per unit area in the overlap region in the printable region of the page information mark with in black ink is smaller than that in the printable region of the page information mark except for the overlap region and the line flushing region. However, the line flushing is performed to the overlap region with ink other than black ink. Consequently, even when the page information mark in the overlap region has a low density, the density can be complemented to the extent that is required for mark detection.

Moreover, the inkjet nozzles in the embodiment of the inkjet printing method are disposed over the width direction of the print medium in a length equal to or more than a width of the print medium.

Moreover, the page information mark in the embodiment of the inkjet printing method is a page top position mark representing information on a page top position in the print medium and printed from the page top position. When the overlap region is present in which the printable region in the page top position mark overlaps the line flushing region, the enhanced ink drying characteristics is obtainable.

Moreover, in the above inkjet printing method, the pre-set color for printing the page information mark is black. Consequently, when the overlap region is present in which the printable region of the page information mark with black ink overlaps the line flushing region with ink other than the black ink, enhanced ink drying characteristics is obtainable.

Another embodiment of the present invention discloses an inkjet printing method of printing an image by controlling printing heads with a controller to discharge ink to a print medium to be transported, the printing heads having a plurality of inkjet nozzles for discharging the ink being disposed in parallel in a width direction intersecting a transportation direction of the print medium. The inkjet printing method includes a line flushing step of performing line flushing to the print medium to be transported in which all of the inkjet nozzles associated with printing of the image discharge the ink individually. The line flushing step includes an ink discharge step of discharging the ink to the print medium to be transported at least one time with any one of two or more groups into which the inkjet nozzles are organized, a group switching step of switching the one group to the other group while the ink discharge step is performed when the ink is discharged a pre-set number of times to the print medium to be transported, and an at least one round taking step of taking at least one round of discharging the ink in the ink discharge step and discharging the ink from the groups in the group switching step.

With the inkjet printing method according to the other embodiment of the present invention, the controller controls all of the inkjet nozzles associated with the printing of the image for performing the line flushing to discharge ink to the print medium. At this time, the controller controls any one of the two or more groups into which the inkjet nozzles are organized to discharge ink at least one time to the print medium to be transported. Simultaneously, the controller controls the one group to be switched to the other group when the ink is discharged a pre-set number of times to the print medium to be transported. Thereafter, the controller controls the groups to take at least one round of the ink discharge at least one time. This achieves a suppressed ink discharge amount per unit area by the line flushing, allowing enhanced ink drying characteristics.

Moreover, it is preferable in the inkjet printing method that the inkjet nozzles in the groups are each disposed at one or plural intervals. This allows suppression of unevenness in ink drying characteristics.

Moreover, it is preferable that the inkjet printing method further includes a mark printing step of printing a page information mark onto the print medium to be transported along with the line flushing, the page information mark representing page information on the print medium. The page information mark is printed such that an overlap region is present in which the printable region of the page information mark with the pre-set color ink overlaps a line flushing region with ink other than the pre-set color ink.

Here, the overlap region is present in which the printable region of the page information mark with black ink overlaps the line flushing region with ink other than black ink, e.g., with cyan ink. In this case, an ink discharge amount per unit area by the line flushing is also decreased, allowing enhanced ink drying characteristics in the overlap region. In addition, overlapping the printable region of the page information mark with the line flushing region achieves a large printable region of the image data in the transportation direction of the print medium.

Moreover, the mark printing step in the inkjet printing method includes an ink discharge amount decreasing step of decreasing an ink discharge amount per unit area in the overlap region in the printable region of the page information mark to be smaller than that in the printable region of the page information mark except for the overlap region and the line flushing region. Such is preferable. This allows a decreased ink discharge amount per unit area in the overlap region in the printable region of the page information mark while an ink density required for detection of the mark is complemented. This achieves decreased ink discharge amounts per unit area in the overlap region for both printing of the page information mark and the line flushing, allowing enhanced ink drying characteristics in the overlap region.

Another embodiment of the present invention discloses an inkjet printing apparatus discharging ink to a print medium to be transported to print an image. The apparatus includes printing heads each having a plurality of inkjet nozzles for discharging the ink being disposed in parallel in a width direction intersecting a transportation direction of the print medium; and a controller controlling the printing heads. The controller performs control to print a page information mark, representing page information on the print medium, to the print medium with pre-set color ink, and controls all of the inkjet nozzles associated with printing of the image to discharge the ink to the print medium to perform line flushing. Upon printing of the page information mark, when an overlap region is present in which a printable region of the page information mark overlaps a line flushing region with ink other than the pre-set color ink, the controller performs control to decrease an ink discharge amount per unit area in the overlap region in the printable region of the page information mark to be smaller than that in the printable region of the page information mark except for the overlap region and the line flushing region.

With the inkjet printing apparatus according to the other embodiment of the present invention, the printing heads each have a plurality of inkjet nozzles discharging the ink. The inkjet nozzles are disposed in parallel in the width direction intersecting the transportation direction of the print medium. The controller controls the printing heads to print the page information mark, representing the page information on the print medium, with the pre-set color ink, and to perform the line flushing. Upon of printing the page information mark, when the overlap region is present in which the printable region of the page information mark overlaps the line flushing region with the ink other than the pre-set color ink, the controller performs control to decrease the ink discharge amount per unit area in the overlap region in the printable region of the page information mark to be smaller than that in the printable region of the page information mark except for the overlap region and the line flushing region. This causes a decreased total ink discharge amount in the overlap region, achieving enhanced ink drying characteristics.

In addition, the ink discharge amount per unit area in the overlap region in the printable region of the page information mark with black ink is smaller than that in the printable region of the page information mark except for the overlap region and the line flushing region. However, the line flushing is performed to the overlap region with ink other than black ink. As a result, even when the page information mark in the overlap region has a low density, the density can be complemented to the extent that is required for mark detection.

Another embodiment of the present invention discloses an inkjet printing apparatus discharging ink to a print medium to be transported to print an image. The inkjet printing apparatus includes printing heads each having a plurality of inkjet nozzles for discharging the ink being disposed in parallel in a width direction intersecting a transportation direction of the print medium; and a controller controlling the printing heads. The controller controls all of the inkjet nozzles associated with printing of the image to discharge the ink to the print medium to perform line flushing. Upon performing the line flushing, the controller performs control to discharge the ink to the print medium to be transported at least one time with any one of two or more groups into which the inkjet nozzles are organized, and performs control to switch the one group to the other group when the ink is discharged a pre-set number of times to the print medium to be transported and to take at least one round of discharging the ink with the groups.

With the inkjet printing apparatus according to the other embodiment of the present invention, the controller controls all of the inkjet nozzles associated with the print of the image to discharge the ink to the print medium for performing the line flushing. At this time the controller performs control to discharge the ink at least one time to the print medium to be transported with any one of the two or more groups into which the inkjet nozzles are organized. Simultaneously, the controller performs control to switch the one group to the other group when the ink is discharged for a pre-set number of times to the print medium to be transported. Thereafter, the controller performs control to take at least one round of discharging the ink with the groups. This allows a decreased ink discharge amount per unit area by the line flushing, achieving enhanced ink drying characteristics.

Advantageous Effects of Invention

With the inkjet printing method and the inkjet printing apparatus according to the embodiments of the present invention, the printing heads each have a plurality of inkjet nozzles discharging the ink. The inkjet nozzles are disposed in parallel in the width direction intersecting the transportation direction of the print medium. The controller controls the printing heads to print the page information mark, representing the page information on the print medium, with the pre-set color ink, and to perform the line flushing. Upon printing the page information mark, when the overlap region is present in which the printable region of the page information mark overlaps the line flushing regions with the ink other than the pre-set color ink, the controller performs control to decrease an ink discharge amount per unit area in the overlap region in the printable region of the page information mark to be smaller than the printable region of the page information mark except for the overlap region and the line flushing region. This causes a decreased total amount of ink discharge in the overlap region, achieving enhanced ink drying characteristics.

In addition, with the inkjet printing method and the inkjet printing apparatus according to the embodiments of the present invention, the controller controls all of the inkjet nozzles associated with the printing of the image to discharge the ink to the print medium for performing the line flushing. At this time, the controller performs control to discharge the ink at least one time to the print medium to be transported with any one of the two or more groups into which the inkjet nozzles are organized. Simultaneously, the controller performs control to switch the one group to the other group when the ink is discharged a pre-set number of times to the print medium to be transported. Thereafter, the controller performs control to take at least one round of ink discharge with the groups individually. This achieves a decreased ink discharge amount per unit area by the line flushing, leading to enhanced ink drying characteristics.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

EMBODIMENT 1

Figure 1A:
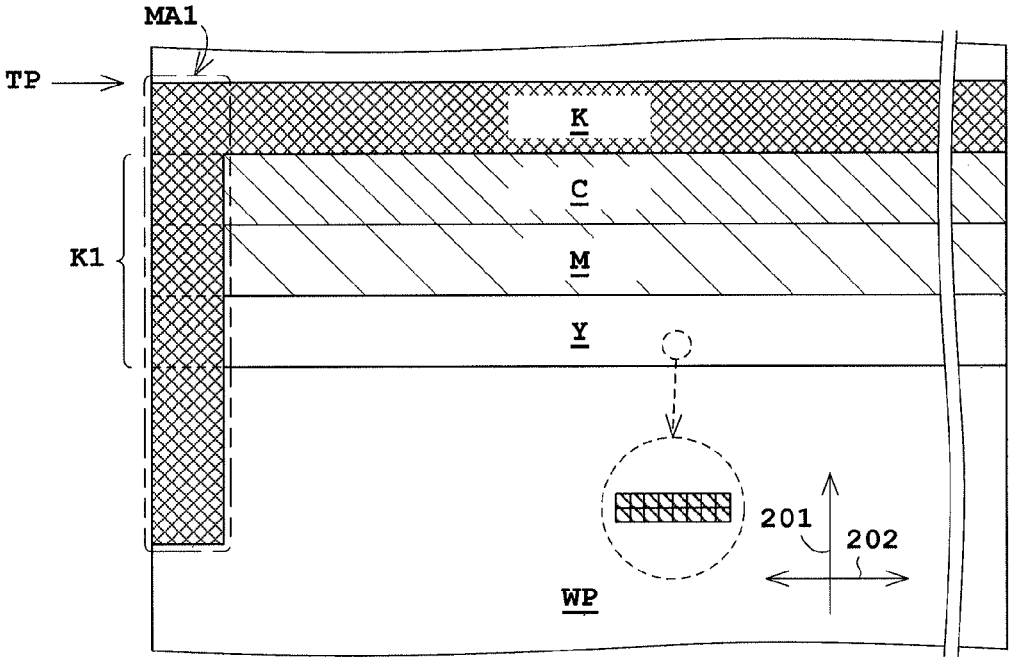
Fig. 1A (PRIOR ART)
FIG. 1A illustrates a printable region of a printing start mark and a line flushing region.
Figure 1B:
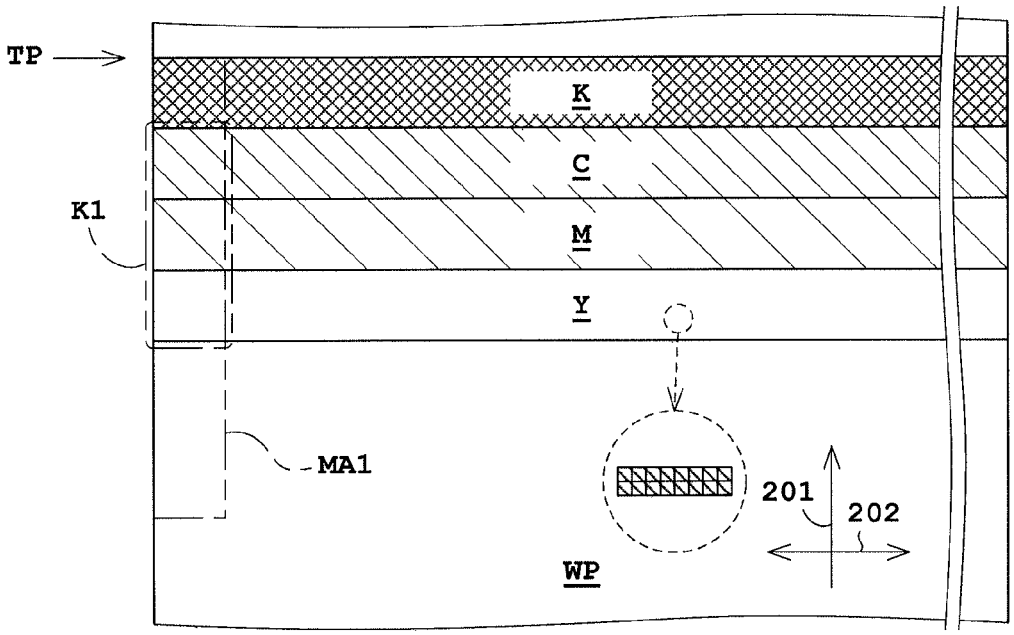
Fig. 1B (PRIOR ART)
FIG. 1B mainly illustrates the line flushing region.
Figure 2:
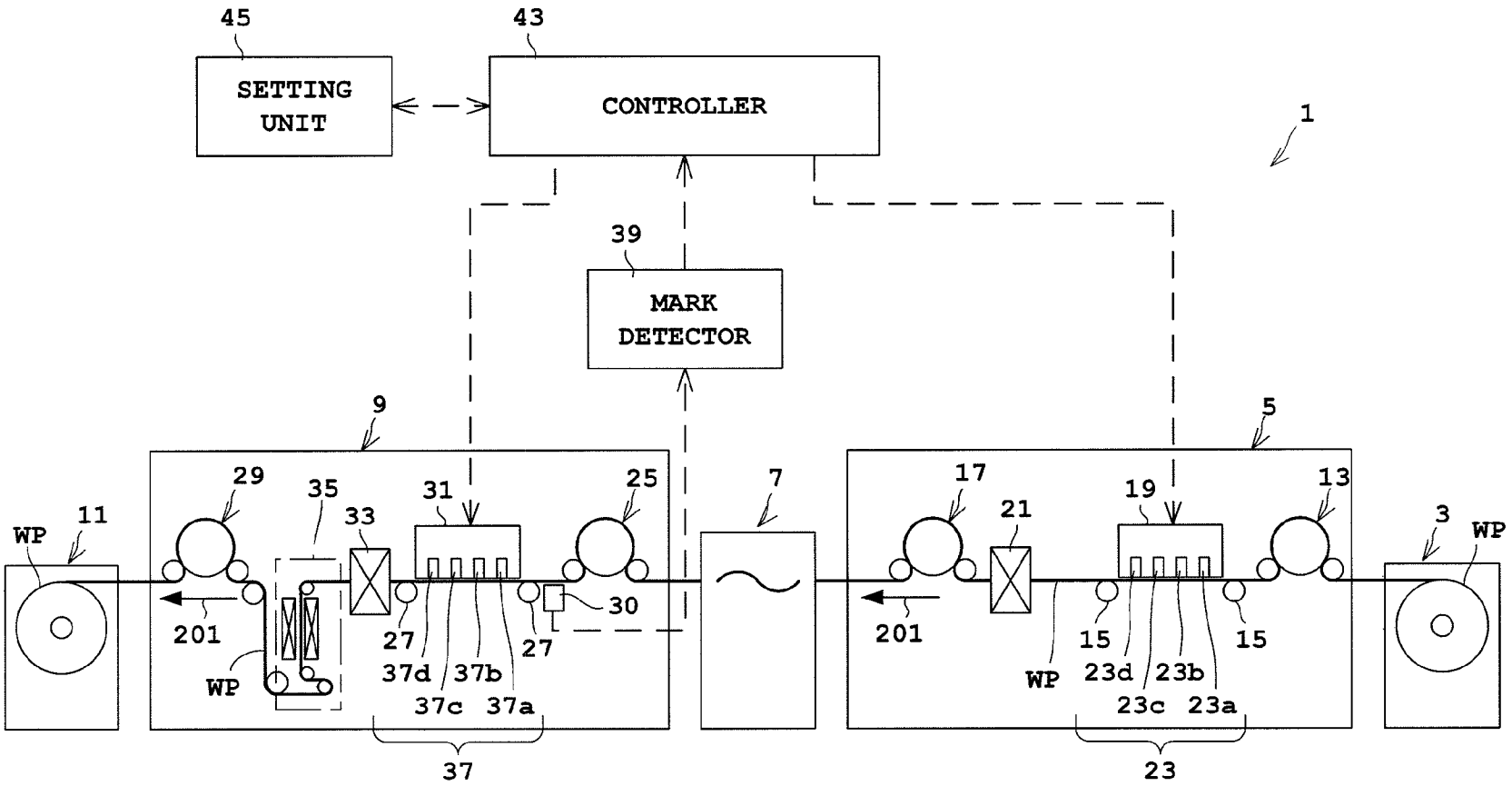
FIG. 2 schematically illustrates an inkjet printing apparatus according to one embodiment of the present invention.
Figure 3:
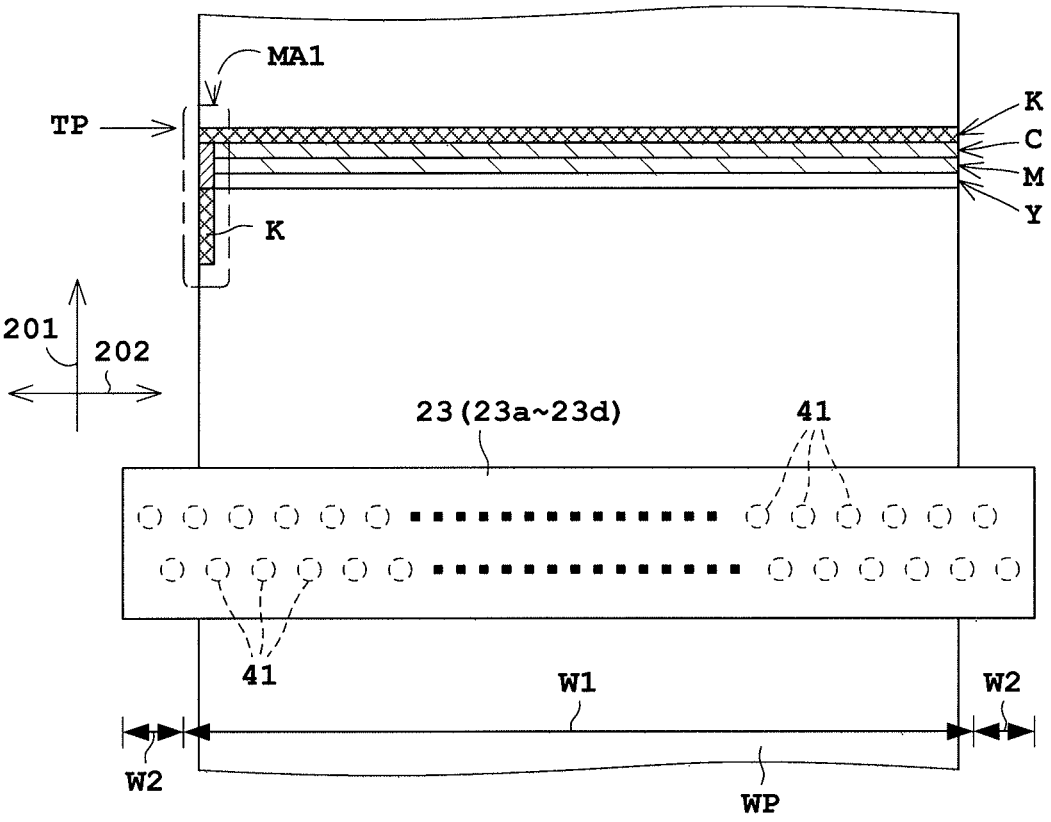
FIG. 3 is an explanatory view of printing heads.
Figure 4A:
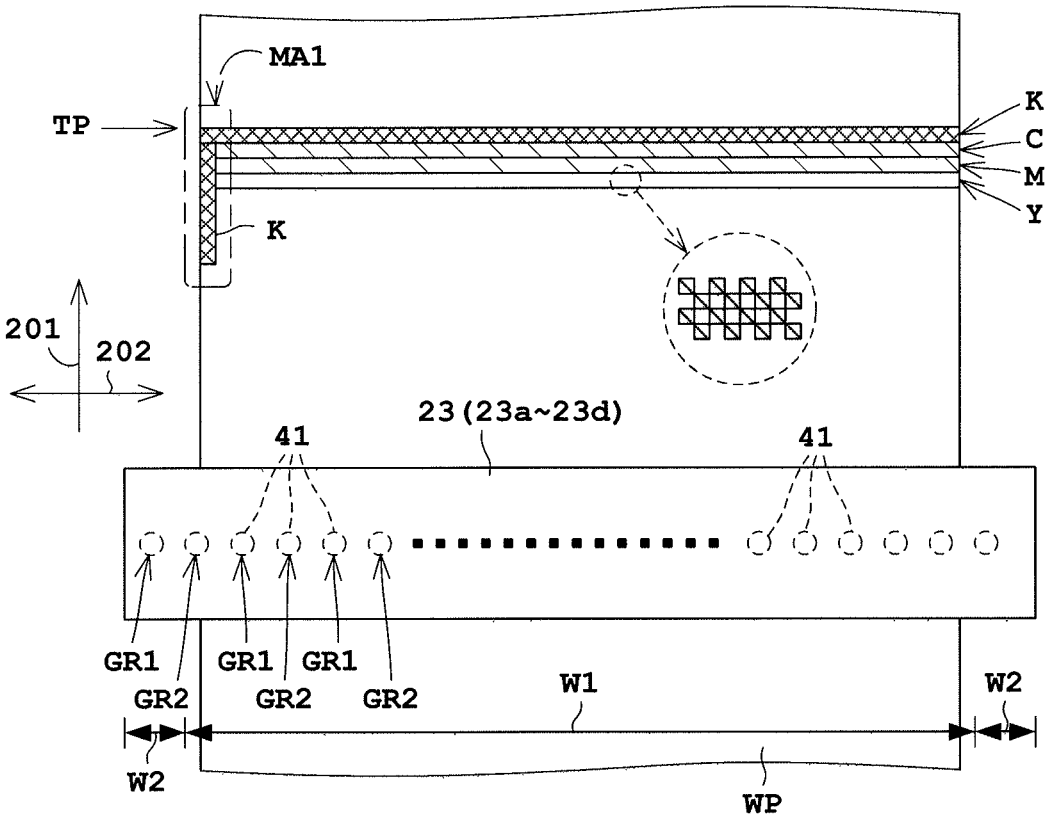
FIGS. 4A and 4B each illustrate the printing heads.
Figure 4B:
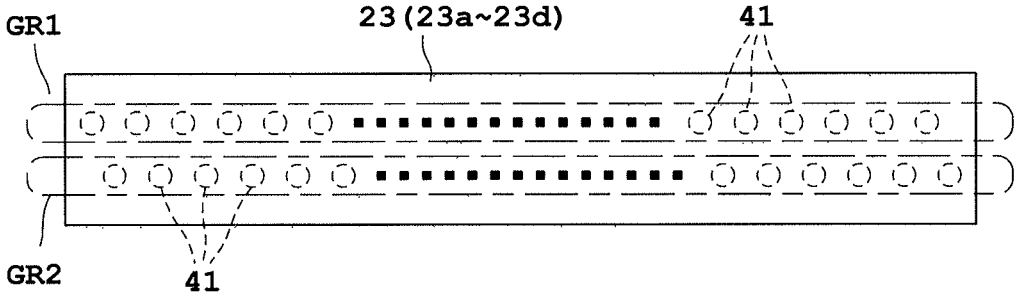

The following describes embodiments of the present invention with reference to drawings. FIG. 2 schematically illustrates an inkjet printing apparatus according to one embodiment of the present invention. FIGS. 3, 4A, and 4B each explanatorily illustrate printing heads.

Reference is made to FIG. 2. An inkjet printing apparatus (hereinafter, referred to as a "printing apparatus") 1 includes a paper feeder 3, a front-face print unit 5, an inversion unit 7, a rear-face print unit 9, and a take-up roller 11.

The paper feeder 3 holds web paper WP in a roll form to be rotatable about a horizontal axis. The paper feeder 3 unwinds and feeds the web paper WP to the front-face print unit 5. The front-face print unit 5 is, for example, of an inkjet type, and performs printing to a front face of the web paper WP. The inversion unit 7 includes a plurality of rollers, and reverses the web paper WP so as for the front face thereof to be directed downward. The rear-face print unit 9 is, for example, of an inkjet type, and performs printing to a rear face of the web paper WP. The take-up roller 11 winds up the web paper WP with the printed front and rear faces in a roll form about the horizontal axis.

Regarding the side from which the web paper WP is fed as upstream and the side to which the web paper WP is fed out as downstream, the paper feeder 3 is disposed upstream of the front-face print unit 5, whereas the take-up roller 11 is disposed downstream of the rear-face print unit 9. Here, the web paper WP corresponds to the "print medium" in the present invention.

The front-face print unit 5 includes a drive roller 13 upstream thereof. The drive unit 13 takes the web paper WP from the paper feeder 3. The web paper WP unwound from the paper feeder 3 by the drive roller 13 is transported downstream along a plurality of transport rollers 15. The front face print unit 5 includes a drive roller 17 on the most downstream position thereof. A print unit 19 and a drier 21 are disposed in this order from upstream between the drive rollers 13 and 17. The print unit 19 includes inkjet heads 23 discharging ink (ink droplets). The drier 21 dries a portion of the web paper WP printed by the printer 19.

The inversion unit 7 inverts a side of the web paper WP fed out from the drive roller 17 of the front-face print unit 5. Then the inversion unit 7 feeds out the inverted web paper WP to the rear-face print unit 9.

The rear-face print unit 9 includes a driving roller 25 upstream thereof. The drive roller 25 takes the web paper WP from the inversion unit 7. The web paper WP taken by the drive roller 25 is transported downstream along a plurality of transporting rollers 27. The rear-face print unit 9 includes a drive roller 29 in the most downstream position thereof. The rear-face print unit 9 includes an imaging unit 30, a printer 31, a drier 33, and a both-side inspecting unit 35 in this order from the upstream between the drive rollers 25 and 29. The printer 31 includes inkjet heads 37 discharging ink. The drier 33 dries a portion of the web paper WP printed by the printer 31. The both-side inspecting unit 35 inspects both sides of the web paper WP printed by the print units 19 and 31.

Here, the transport rollers 15, and 27 are rotatable rollers with no drive mechanism. The drive rollers 13, 17, 25, and 29 are each rotated by a drive unit such as a motor.

The imaging unit 30 is disposed below and away from a lower surface of the web paper WP. The imaging unit 30 captures a region having a printing start mark MA1 as an optical image. The printing start mark MA is printed on a part of the web paper WP. The printing start mark MA1 is used for determining a timing of starting printing onto the rear-face of the web paper WP. The front-face print unit 5 executes the printing of the printing start mark MA1 and line flushing. A mark detector 39 detects the printing start mark MA1 based on an image in the region having the printing start mark MA1 captured by the imaging unit 30. In addition, the mark detector 39 outputs a signal indicating the printing start mark MA1 with a controller 43, to be mentioned later, for performing printing of the rear face.

The following describes the print unit 19 of the front-face print unit 5. The print unit 19 includes a plurality of (e.g., four) printing heads 23. The printing heads 23 are disposed in a transportation direction 201 of the web paper WP. The printing heads 23 consists of a first printing head 23*a*, a second printing head 23*b*, a third printing head 23*c*, and a fourth printing head 23*d* in this order from upstream. The web paper WP is subjected to printing with the printing heads 23 in the above order. The printing heads 23*a* to 23*d* are individually spaced away from each other at a given distance in the transportation direction 201. The printing heads 23 are each a piezo driving system or a thermal driving system to discharge ink.

The four printing heads 23*a* to 23*d* discharge ink for printing. For instance, the first printing head 23*a* discharges ink in black (K), and the second printing head 23*b* discharges ink in cyan (C). The third printing head 23*c* discharges ink in magenta (M), and the fourth printing head 23*d* discharges ink in yellow (Y). The ink in different colors is supplied from a supplying unit, not shown.

As illustrated in FIGS. 3, 4A, and 4B, the printing heads 23 each include a plurality of inkjet nozzles 41 discharging ink. The inkjet nozzles 41 are disposed in a length equal to or more than a width of the web paper WP over the width direction 202 of the web paper WP. Here, the width direction (primary scanning direction) 202 of the web paper WP is substantially orthogonal to (intersects) the transportation direction (secondary scanning direction) 201 of the web paper WP. In FIGS. 3 and 4B, the inkjet nozzles 41 are disposed in a staggered arrangement. Alternatively, as illustrated in FIG. 4A, the inkjet nozzles 41 may be disposed in line. Moreover, the printing head 23 is formed by single unit in FIGS. 3, 4A, and 4B. Alternatively, a plurality of short inkjet heads is disposed in line or in a staggered manner in the width direction 202 to form the printing head 23. The printing heads 23 are each fixed on its setting position in the transportation direction 201 and the width direction 202. Description about FIGS. 4A and 4B is to be made later in Embodiment 2.

The print unit 31 of the rear-face print unit 9 includes printing heads 37 (37*a* to 37*d*). Since the print unit 31 is configured in the same manner as the print unit 19 mentioned above, the description thereof is to be omitted. Hereinunder, the printing head 23*a* to 23*d* are simply referred to as the "printing heads 23" when the heads are not particularly distinguished from one another. The same is applied to the printing heads 37.

As illustrated in FIG. 2, the printing apparatus 1 further includes a controller 43 and a setting unit 45. The controller 43 controls en bloc components of the printing apparatus 1, such as the front-face print unit 5 and the rear-face print unit 9. The controller 43 is formed by a computer having a liquid crystal monitor, the setting unit 45, a storing unit, and a central processing unit (CPU). The liquid crystal monitor displays an operation screen and the like. The setting unit 45 functions as an input unit such as a keyboard or a switch. The storing unit stores image data and the like. Here, the storing unit stores signals such as a discharge waveform signal for normal printing used for printing the printing start mark MA1 and the image data, and a discharge waveform signal for line flushing used for the line flushing.

Figure 5A:
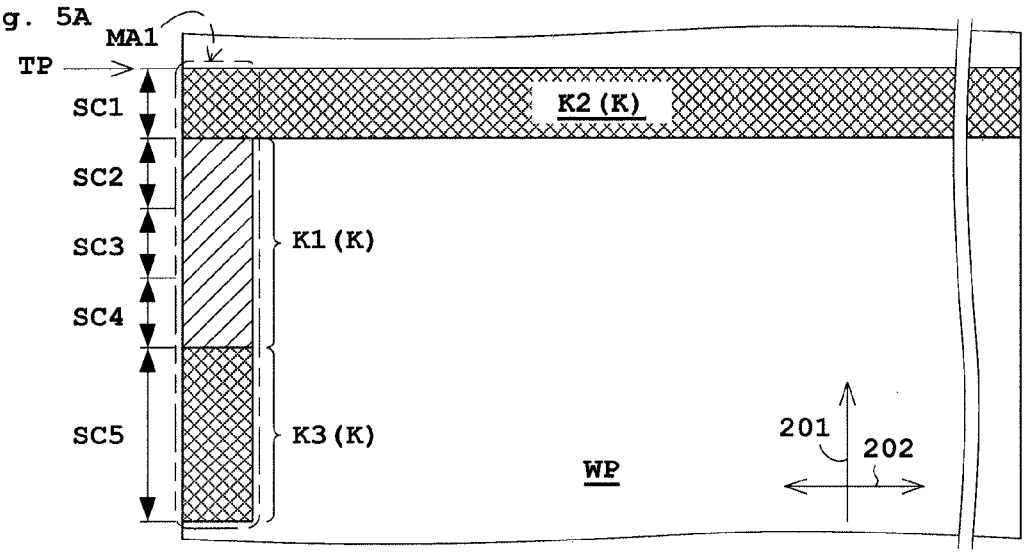
FIGS. 5A to 5C are each an explanatory view of printing of the printing start mark and line flushing.
Figure 5B:
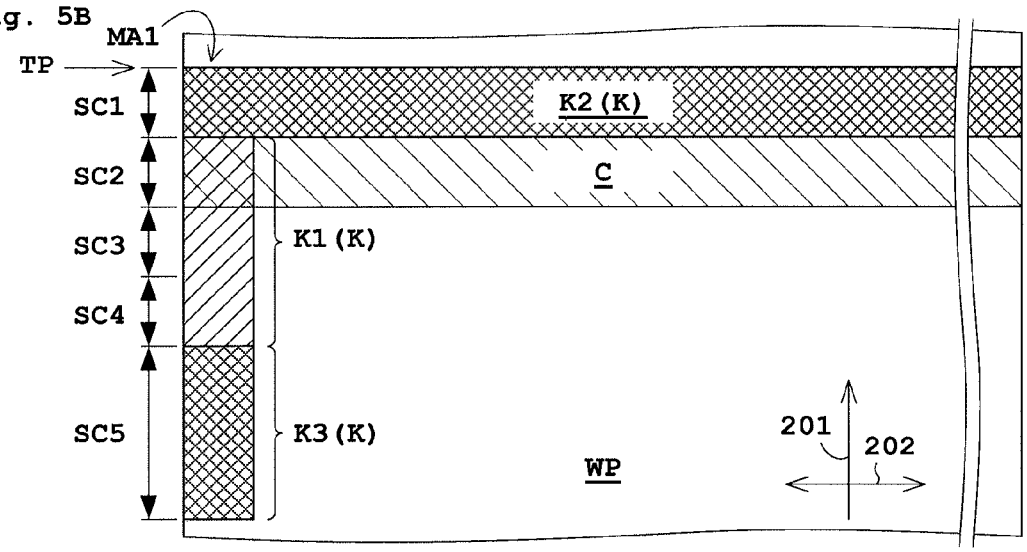
Figure 5C:
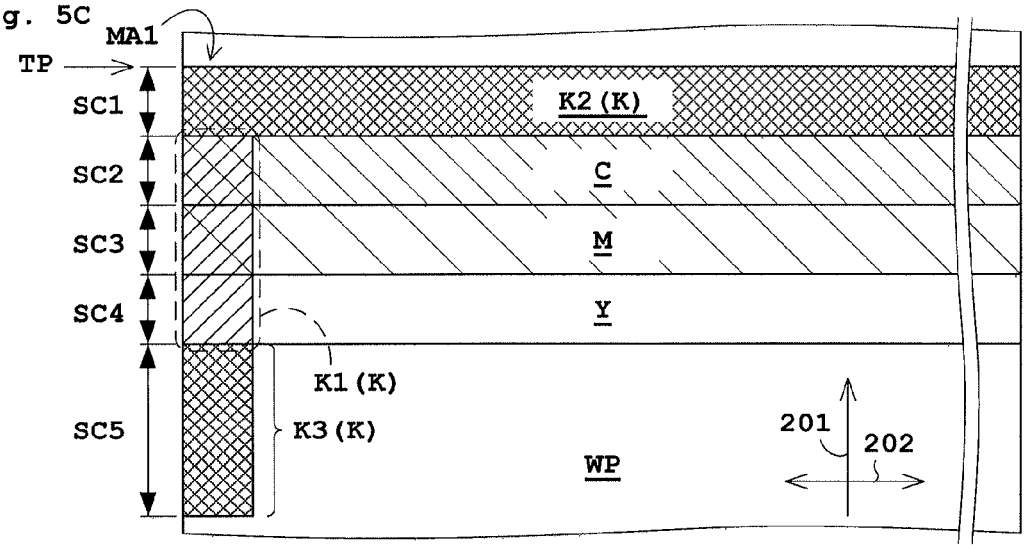

The following describes the controller 43 as the characteristic feature of the present invention. The controller 43 controls discharge of ink from the printing heads 23. In addition, as illustrated in FIGS. 5A to 5C, the controller 43 performs control to print the printing start mark MA1, and performs control to discharge ink from all the inkjet nozzles 41 for the line flushing. The printing start mark MA1 consists of a line flushing region K2 for black ink, an overlap region K1 to be mentioned later, and a region K3 except for the regions K1 and K2.

Moreover, when an overlap region K1 is present in which a printable region MA1 of the printing start mark MA1 with black ink overlaps regions C, M, and Y for the line flushing with ink other than the black ink, i.e., in cyan, magenta, and yellow, respectively, upon printing the printing start mark MA1, the controller 43 controls to decrease an ink discharge amount (ink adhesion amount) per unit area in the overlap region K1 in a printable region of the printing start mark MA1 to be smaller than that in the region K3, except for the overlap region K1 and the line flushing region K2, in which the printing start mark MA1 is printed. Here, the overlap region K1 is determined and set in advance. From this, the controller 43 may perform control to determine the overlap region K1 based on the printing start mark MA1 and a position where the line flushing is performed.

The printing start mark MA1 is used for double-faced printing, and is printed onto a front face of the web paper WP with the printing heads 23 of the front-face print unit 5 in FIG. 2. As illustrated in FIG. 3, the printing start mark MA1 is disposed downstream the page top position TP in the web paper WP, and is typically disposed on the left end of the web paper WP in the width direction 202. After the printing start mark MA1 is printed, the imaging unit 30 in the rear-face detecting unit 9 captures an image of a region with the printing start mark MA1, and the mark detector 39 detects the printing start mark MA1 based on the captured image. This allows determination of a print timing onto the rear face with the printing head 37, and allows alignment of front- and rear-face pages.

For instance, it is assumed that the line flushing is performed at a 100% discharge amount. Consequently, in the overlap region K1, the line flushing is performed at a 100% discharge amount with cyan ink or the like to the printing start mark MA1 with which black ink is discharged at an 80% discharge amount. That is, conventionally, a total 180% ink discharge amount per unit area is applied to the overlap region K1. Here, it is assumed that an upper limit of an ink discharge amount per unit area is, for example, 160% depending on characteristics of the web paper WP such as a thickness. In this case, the total 180% amount of ink discharge exceeds the upper limit. As a result, transfer of adhered ink to another portion or show-through occurs. Such a problem may arise.

Accordingly, in the embodiment of the present invention, an ink discharge amount per unit area in the overlap region K1 in a printable region of the printing start mark MA1 is decreased to be smaller than that for the region K3 in the printing start mark MA1 with black ink, e.g., less than 60%. This allows enhanced ink drying characteristics.

The following describes operation of the printing apparatus 1. Here, printing of the printing start mark MA1 and the line flushing are especially described in detail with reference to FIGS. 5A to 5C. It should be noted that, although the line flushing with black ink and printing of the printing start mark MA1 are performed before the line flushing with C-, M-, and Y-ink for the purpose of the explanation given hereinafter, printing of the printing start mark MA1 and the line flushing with C-, M-, and Y-ink are actually performed at the same time.

<Black Ink Discharge from First Printing Head 23*a*>

In FIG. 5A, the controller 43 controls the first printing head 23*a* in FIG. 2 to discharge black ink. The controller 43 controls all the inkjet nozzles 41 of the printing head 23*a* to perform line flushing in a section SC1 adjoining to the page top position TP. Through the line flushing, the printing start mark MA1 is printed onto the section SC1. Similarly, line flushing is performed under the same condition with other color ink. The region K2 formed by the section SC1 has no overlap region with colors other than black (cyan, magenta, and yellow).

The region K1 formed by next sections SC2 to SC4 is subjected to line flushing with colors other than black individually. Accordingly, the overlap region K1 is present in which the region MA1 overlaps the regions C, M, and Y. The region MA1 corresponds to the printing start mark MA1 printed with black ink. The regions C, M, and Y are each a region to which line flushing is performed with ink other than black ink, respectively. Consequently, the controller 43 performs control to decrease the ink discharge amount per unit area in the overlap region K1 in the printable region for the printing start mark MA1 to be smaller than for the region K3 in the printing start mark MA1 with black ink upon printing the printing start mark MA1. This allows a lower density of the black ink in the sections SC2 to SC4 in the region K1 than that in the section SC5 in the region K3.

The mark detector 39 sets in advance a density threshold for detecting the mark with a white and black solid printing image in the web paper WP. In the overlap region K1, an ink discharge amount per unit area is set and a threshold is set so as for the printing image in multiple colors has a threshold exceeding the threshold set in advance.

The region K3 formed by the next section SC5 is a region in which the region MA1 does not overlap the regions in colors other than black. The printing start mark MA1 in the section SC5 is printed only with black ink. Accordingly, the printing start mark MA1 in the section SC5 is printed at a sufficient ink discharge amount (density) per unit area so as not to prevent detection of the printing start mark MA1 by the mark detector 39. Here, as noted above, black ink discharge amounts per unit area in the sections SC2 to SC4 are each smaller than that in the section SC5.

The printing start mark MA1 in the section SC5 may be printed under the same discharge condition as that for the line flushing in the section SC1.

As noted above, the printing of the printing start mark MA1 and the line flushing with black ink are performed.

<Cyan Ink Discharge by Second Printing Head 23*b*>

In FIG. 5B, the controller 43 controls the second printing head 23*b* in FIG. 2 to discharge cyan ink. The controller 43 controls all the inkjet nozzles 41 of the printing head 23*b* to perform line flushing in a section SC2. The line flushing region C overlaps the printable region MA1 corresponding to the printing start mark MA1. The line flushing region C includes the overlap region K1 whose ink discharge amount per unit area in the overlap region K1 in the printing start mark MA1 with black ink is smaller than that for the region K3 in the printing start mark MA1 with black ink. Consequently, in the overlap region K1, this achieves a total decreased ink discharge amount per unit area by the printable region of the printing start mark MA1 with black ink and the line flushing with cyan ink.

<Magenta and Yellow Ink Discharge by Third and Fourth Printing Heads 23*c*, 23*d*, Respectively>

In FIG. 5C, the controller 43 controls the third printing head 23*c* in FIG. 2 to discharge magenta ink. The controller 43 also controls the fourth printing head 23*d* to discharge yellow ink. The controller 43 controls all the inkjet nozzles 41 of the printing head 23*c* to perform line flushing in the section SC3. The controller 43 controls all the inkjet nozzles 41 of the printing head 23*d* to perform line flushing in the section SC4.

The line flushing regions M and Y overlap the printable region MA1 corresponding to the printing start mark MA. The line flushing regions M and Y include the overlap region K1 whose ink discharge amounts per unit area in the overlap region K1 in the printing start mark MA1 with black ink are smaller than that in the region K3 in the printing start mark MA1 with black ink. Consequently, this achieves total decreased ink discharge amounts per unit area in the overlap region K1 in the printing start mark MA1 with black ink and for the line flushing with magenta and yellow ink.

With the embodiment of the present embodiment, the printing heads 23 each have a plurality of inkjet nozzles 41 discharging ink. The inkjet nozzles 41 are disposed in parallel in the width direction 202 substantially orthogonal to the transportation direction 201 of the web paper WP. The controller 43 controls the printing heads 23 to print the printing start mark MA1 with black ink, and to perform the line flushing. Upon printing of the printing start mark MA1, when the overlap region K1 is present in which the line flushing regions C, M, and Y with the ink other than black ink overlap the printable region MA1 of the printing start mark MA1, the controller 43 performs control to decrease an ink discharge amount per unit area in the overlap region K1 in the printing start mark MA1 to be smaller than that in the region K3 in the printing start mark MA1 except for the overlap region K1 and the line flushing region K2. This causes a decreased total ink discharge amount in the overlap region K1, achieving enhanced ink drying characteristics.

Moreover, the ink discharge amount per unit area in the overlap region K1 in the printing start mark MA1 with black ink is smaller than that in the region K3 in the printing start mark MA1 except for the overlap region K1 and the line flushing region K2. On the other hand, the line flushing with ink other than black ink (i.e., cyan, magenta and yellow ink) is performed to the overlap region K1. As a result, the density can be complemented to the extent that is required for detection of the mark although the density of the printing start mark MA1 in the overlap region K1 decreases.

EMBODIMENT 2

The following describes Embodiment 2 of the present invention with reference to drawings. Here, the description common to that of Embodiment 1 is to be omitted. In Embodiment 1, ink drying characteristics are enhanced through the printing of the printing start mark MA1. In contrast to this, in Embodiment 2, ink drying characteristics are enhanced through the line flushing.

The following describes the controller 43 in the present embodiment. The controller 43 controls (commands) ink discharge by the printing heads 23. Then, the controller 43 controls all the inkjet nozzles 41 to discharge ink for performing line flushing. The inkjet nozzles 41 individually discharge ink for a pre-set number of times, and thus all the inkjet nozzles 41 discharge the same amount (the same total amount) of ink.

The line flushing is performed with the waveform discharge signal for line flushing. Here, a one-time ink discharge amount for line flushing through the discharge waveform signal is set larger than that for normal printing through the discharge waveform signal.

Figure 6A:
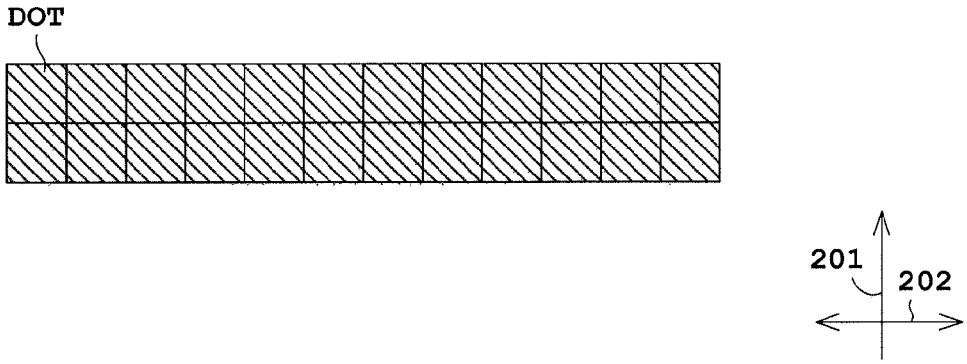
Fig. 6A (PRIOR ART)
FIG. 6A illustrates one example of discharge with currently-used line flushing.
Figure 6B:
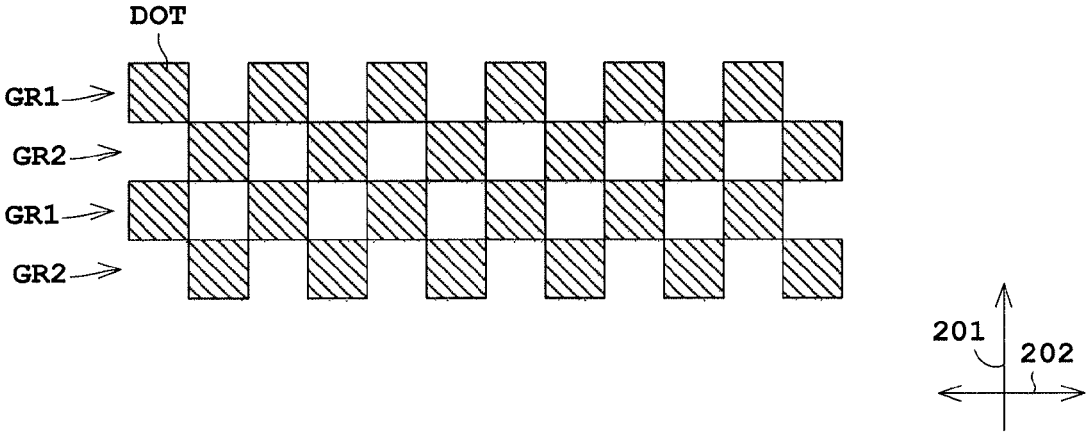
FIG. 6B illustrates one example of discharge with line flushing according to the embodiment of the present invention.

FIG. 6A illustrates one example of discharge with the currently-used line flushing. In the drawing, dots as the resultant of ink discharge are massed solid. In contrast to this, FIG. 6B illustrates one example of discharge with the line flushing in the present invention. Here, dots as the resultant of ink discharge are disposed checkerwise. That is, the controller 43 performs control to discharge ink checkerwise for the line flushing.

The following describes in detail the line flushing by the controller 43. Upon the line flushing through the controller 43, the multiple inkjet nozzles 41 are organized into two groups, i.e., a first group GR1 and a second group GR2. See FIG. 4A. In other words, the controller 43 organizes a dot line in FIG. 6A into the first and second groups GR1 and GR2 as in FIG. 6B. Such group organization is set in advance.

Moreover, the controller 43 performs control to discharge ink to the web paper WP to be transported for at least one time (a pre-set number of times) with any one of the first and second groups GR1 and GR2, e.g., the first group GR1. Simultaneously, the controller 43 performs control to switch the group GR1 to the other second group GR2 when ink is discharged to the web paper WP to be transported for a pre-set number of times (e.g., one time). Then the controller 43 repeats ink discharge by the groups GR1 and GR2 for at least one time.

In FIG. 6B, ink is discharged one time to the web paper WP to be transported, and thereafter the group is switched to the other second group GR2 for discharging ink one time. Thereafter, the group G2 is switched to the first group GR1. Accordingly, two rounds of ink discharge with the groups GR1 and GR2 is taken. Here, the number of rotation of the first and second groups GR1 and GR2 may be two or more. The number or rotation is set depending on a discharge frequency in the line flushing set in advance.

The controller 43 performs control to discharge ink successively at given timings to the web paper WP to be transported. In FIG. 6A, all the inkjet nozzles 41 discharge ink successively two times at a given timing. In FIG. 6B, the controller performs control to discharge ink one time from the first group GR1 at a given timing, and to discharge ink one time from the second group GR2 at another timing. Here, the given timings each indicate a timing to form next adjacent dots upon forming dots successively in the transportation direction 201.

The inkjet nozzles 41 in the groups GR1 and GR2 (see FIG. 4A) are disposed at one interval (one dot) or at plural intervals. The inkjet nozzles 41 are disposed so as for positions of the dots as the resultant of ink discharge to be arranged at equal intervals. This allows suppressed unevenness in ink drying characteristics. Here in FIG. 6B, the dots as the resultant of the ink discharge are positioned at one interval. It is preferable that a pre-set frequency of switching the group is not variable but is invariable. In this case, the dots are also positioned at equal intervals, allowing suppressed unevenness in ink drying characteristics.

Figure 7A:
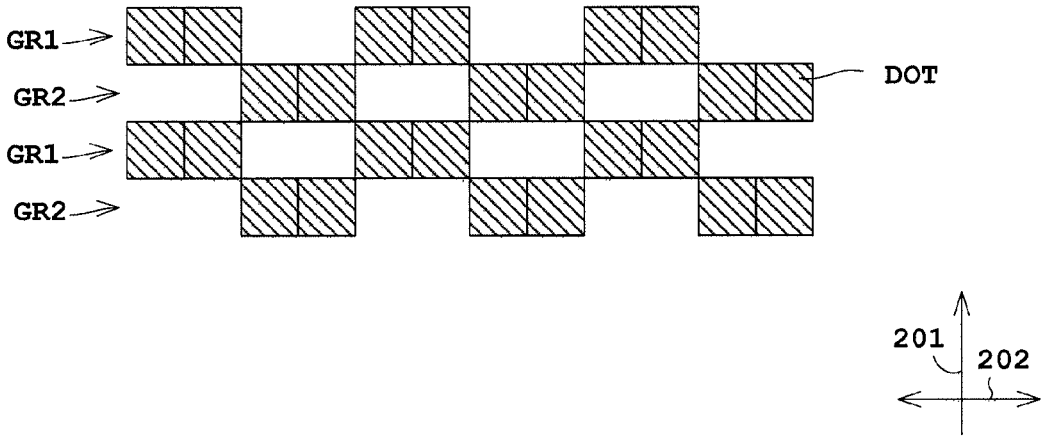
FIGS. 7A to 7C each illustrate another example of discharge with the line flushing according to the embodiment of the present invention.
Figure 7B:
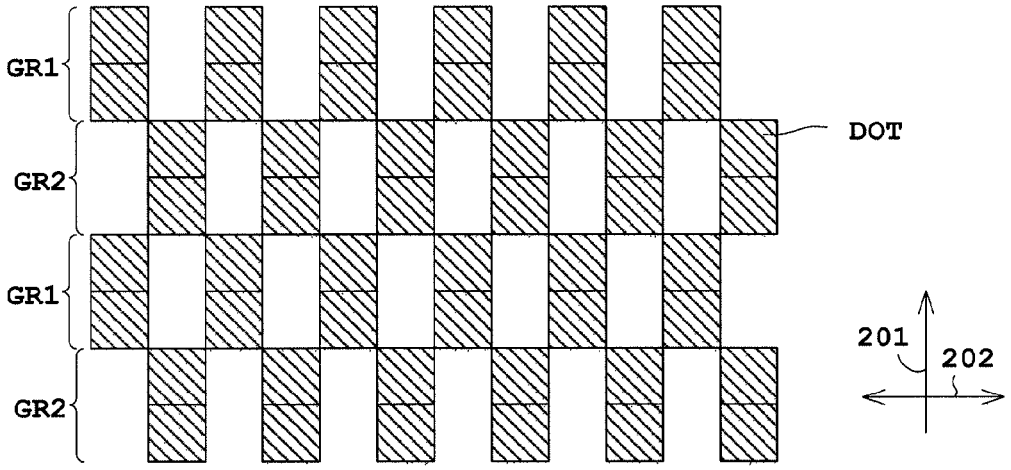
Figure 7C:
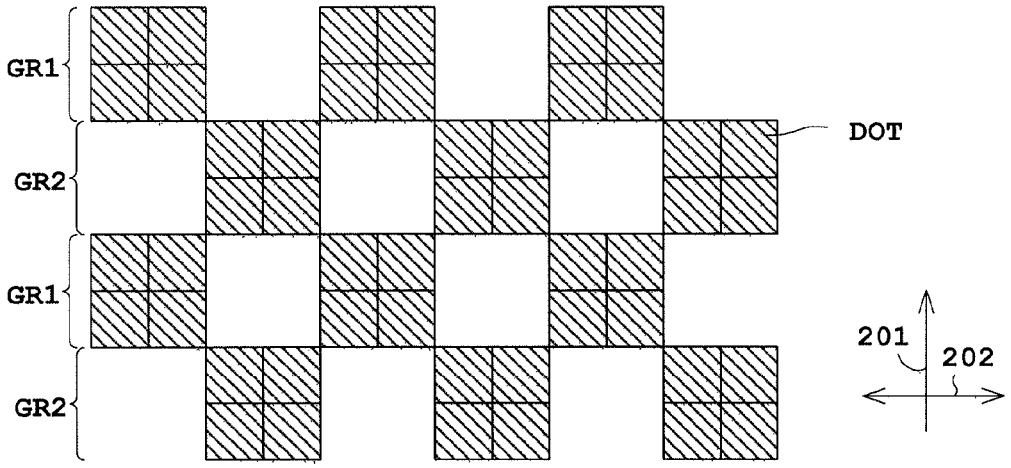
Figure 8A:
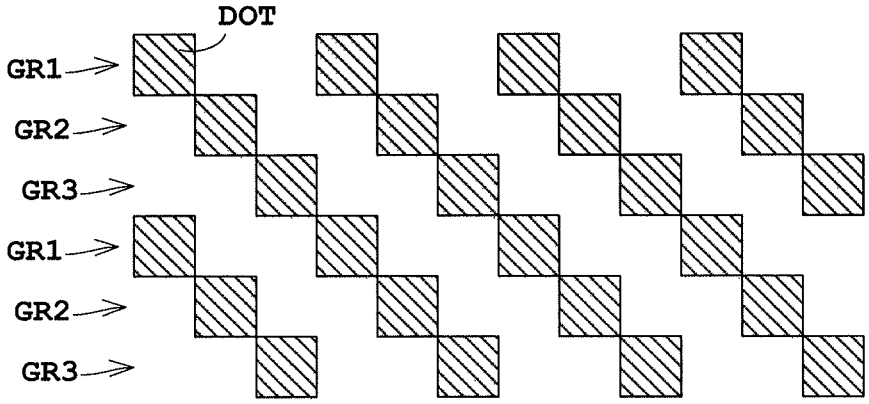
FIGS. 8A and 8B each illustrates another example of discharge with the line flushing according to the embodiment of the present invention.
Figure 8B:
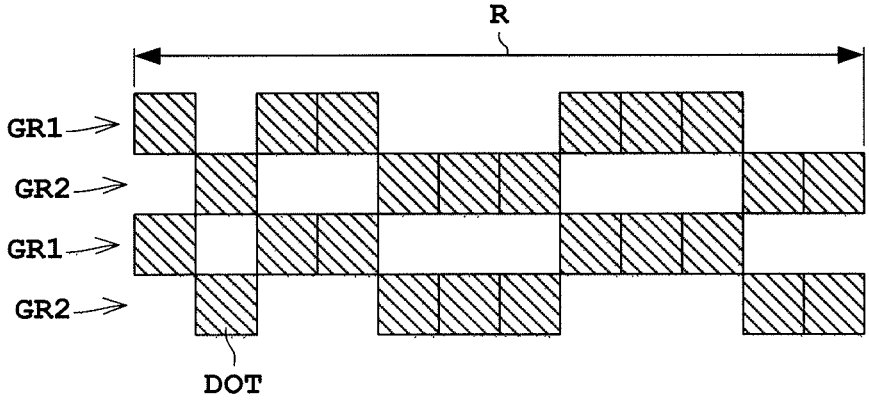

Moreover, the controller 43 may perform control in such a manner as in FIGS. 7A to 7C as well as FIGS. 8A and 8B.

In FIG. 7A, dots as the resultant of ink discharge are positioned close to each other. In the groups GR1 and GR2, the inkjet nozzles 41 (see FIG. 4A) in plural unit (e.g., in two unit) are disposed adjacent to each other. The inkjet nozzles 41 in plural unit (e.g., in two unit) are disposed at plural (e.g., two) intervals in the width direction 202.

In FIG. 7B, the controller 43 performs control to discharge ink to the web paper WP to be transported a pre-set number of times (e.g., two times), and thereafter the group is switched to the second group GR2. In this example, the group is not switched to the other group every one ink discharge, but the ink is discharged successively two times in the same group until the group is switched.

FIG. 7C is a method in combination of FIG. 7A and FIG. 7B. That is, dots as the resultant of the ink discharge are positioned in plural units (e.g., in two units). The ink is discharged successively two times in the transportation direction 201, and then the group is switched.

In FIG. 8A, the inkjet nozzles 41 (see FIG. 4A) are organized into three groups GR1, GR2, and GR3. The controller 43 performs control to discharge ink a pre-set number of times (e.g., one time) to the web paper WP to be transported, and then the group is switched to the second group GR2. Thereafter, the controller 43 performs control to discharge ink from the first group GR1, the second group GR2, and the third group GR3, in this order, in two rounds. In FIG. 8A, the dots are not positioned checkerwise, but are positioned obliquely.

FIG. 8B illustrates a condition under which the dots in the groups GR1 and GR2 are not positioned at equal intervals in an area R. That is, the inkjet nozzles 41 in the groups GR1 and GR2 (see FIG. 4A) are not necessarily disposed at one or plural intervals.

The following describes operation of the printing apparatus 1.

The printing start mark MA1 is used for double-faced printing. The printing start mark MA1 is printed onto a front face of the web paper WP by the printing heads 23 of the front-face print unit 5 in FIG. 2. As illustrated in FIG. 4A, the printing start mark MA1 is disposed downstream of the page top position TP in the web paper WP, and is disposed on the left end of the web paper WP in the width direction 202. After the printing start mark MA1 is printed, the imaging unit 30 in the rear-face detecting unit 9 captures an image containing the printing start mark MA1, and the mark detector 39 detects the printing start mark MA1 based on the captured image. This allows determination of a print timing onto the rear face with the printing heads 37, and allows alignment of front- and rear-face pages.

Figure 9A:
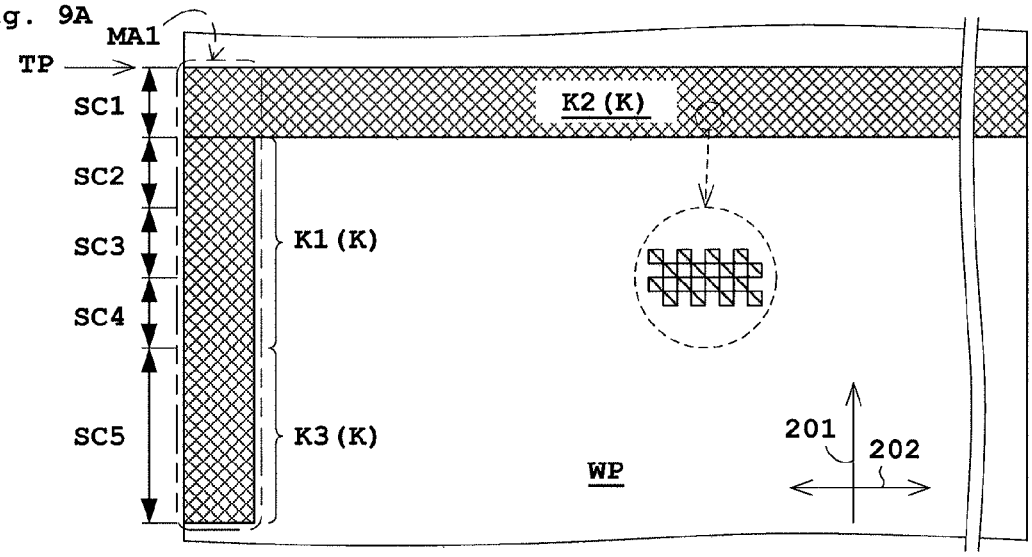
FIGS. 9A to 9C each illustrate printing of a printing start mark and line flushing.
Figure 9B:
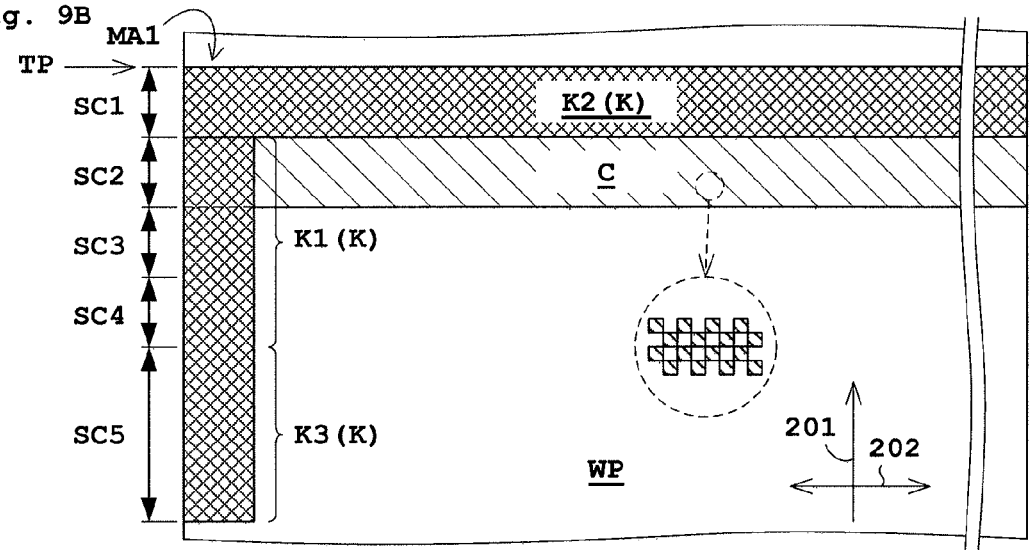
Figure 9C:
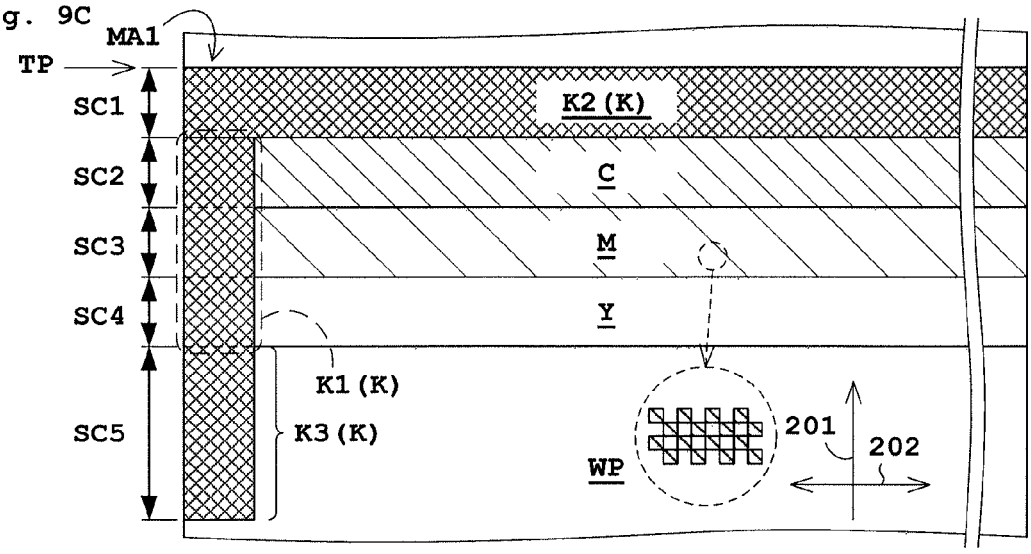

The following firstly descries a summary of operation of the controller 43 in FIGS. 9A to 9C. The controller 43 performs line flushing to the web paper WP (corresponding to the line flushing step in the present invention). Along with the line flushing, the controller 43 performs printing of the printing start mark MA1 (corresponding to the mark printing step in the present invention). Moreover, in either the line flushing or the printing of the printing start mark MA1, the controller 43 determines whether or not an overlap region K1 is generated. In the overlap region K1, the printing start mark MA1 printed with black ink overlaps the regions C, M, and Y in which the line flushing is performed with ink in other colors (i.e., cyan, magenta, and yellow, respectively).

As illustrated in FIGS. 4A and 6B, the controller 43 organizes in advance the inkjet nozzles 41 into two groups, i.e., the first group GR1 and the second group GR2. Upon the line flushing with black, cyan, magenta and yellow ink, respectively, the controller 43 performs control to discharge ink at least one time to the web paper WP to be transported with any one of the first group GR1 and the second group GR2, i.e., with the first group GR1 (corresponding to the ink discharging step in the present invention). Along with this, the controller 43 performs control to switch the group with the other second group GR2 when ink is discharged one time to the web paper WP to be transported (corresponding to the group switching step in the present invention). Moreover, the controller 43 performs control to take at least one round of ink discharge with the groups GR1 and GR2 (corresponding to the at least one round making step in the present invention). In FIG. 6B, two rounds are taken.

In the above manner, the line flushing in different colors is performed as in FIG. 9C, and simultaneously the printing start mark MA1 is printed.

The following describes operation of the printing heads 23*a* to 23*d* controlled by the controller 43 with reference to FIGS. 9A to 9C.

<Black Ink Discharge by First Printing Head 23*a*>

In FIG. 9A, the controller 43 controls the first printing head 23*a* in FIG. 2 to discharge black ink. Then the controller 43 performs line flushing in the section SC1 adjoining the page top position TP. Here, the line flushing with black ink is performed with a discharge waveform signal for line flushing. The line flushing with cyan, magenta, and yellow ink, to be mentioned later, is also performed individually with discharge waveform signals for line flushing. The ink in different colors is used for the line flushing under the same condition as for black ink.

As in FIG. 6B, the controller 43 performs control to discharge black ink checkerwise for line flushing as in the printable region K2 in FIG. 9A.

This allows a decreased ink discharge amount per unit area by the line flushing with black ink. Accordingly, the line flushing region K2 has enhanced ink drying characteristics. Here, the line flushing with black ink causes the printing start mark MA1 to be printed in the section SC1.

Then the rest of the printing of the printing start mark MA1 is performed to next sections SC2 to SC5. The sections SC2 to SC4 each include an overlap region K1 in the printing start mark MA1 with black ink overlaps the line flushing regions C, M, and Y printed with ink than the black ink. The printing start mark MA1 with the black ink in each of the sections SC2 to SC5 is printed with a discharge waveform signal for normal printing. The printing start mark MA1 in the sections SC2 to SC4 is printed at the same ink discharge amount per unit area as for the section SC5.

<Cyan Ink Discharge by Second Printing Head 23*b*>

In FIG. 9B, the controller 43 controls the second printing head 23*b* in FIG. 2 to discharge cyan ink. Then the controller 43 performs line flushing with cyan ink in the section SC2. Similar to the line flushing with black ink, the line flushing with cyan ink is performed by discharging ink checkerwise. Accordingly, a decreased ink discharge amount per unit area in the line flushing region C is obtainable. This allows enhanced ink drying characteristics in the line flushing region C.

The line flushing region C for cyan ink overlaps the printing start mark MA1 with black ink at the overlap region K1. On the other hand, the ink is discharged checkerwise to the line flushing region C for cyan ink. Accordingly, an ink discharge amount (ink adhesion amount) per unit area is decreased. As a result, a total ink discharge amount per unit area in the overlap region K1 can be decreased, leading to enhanced ink drying characteristics.

<Magenta Ink and Yellow Ink Discharge by Third and Fourth Printing Heads 23*c*, 23*d*, Respectively>

In FIG. 9B, the controller 43 controls the third printing head 23*c* in FIG. 2 to discharge magenta ink, and controls the fourth printing head 23*d* to discharge yellow ink. Then the controller 43 performs line flushing with magenta ink in the section SC3, and performs line flushing with yellow ink in the section SC4.

Similar to the line flushing with black ink, the line flushing with the magenta and the yellow ink is performed by discharging the ink checkerwise. Consequently, ink discharge amounts per unit area in the line flushing regions M and Y are each decreased. This allows enhanced ink drying characteristics in the line flushing regions M and Y.

In addition, the line flushing regions M and Y for the magenta and yellow ink each overlap the printing start mark MA1 with black ink at the overlap region K1. On the other hand, the ink is discharged checkerwise to the line flushing regions M and Y. Accordingly, ink discharge amounts per unit area are each decreased. As a result, a total ink discharge amount per unit area in the overlap region K1 can be decreased, leading to enhanced ink drying characteristics.

With the present embodiment, the controller 43 controls all the inkjet nozzles 41 to discharge the ink to the web paper WP for performing the line flushing. At this time, the controller 43 performs control to discharge the ink at least one time to the web paper WP to be transported with any one of the two groups GR1 and GR2, e.g., with the first group GR1. Here, the two groups GR1 and GR2 are organized from the inkjet nozzles 41. Simultaneously, the controller 43 performs control to switch the group to the other second group GR2 when the ink is discharged one time to the web paper WP to be transported. Thereafter, the controller 43 performs control to take at least one round of ink discharge with the groups GR1 and GR2. This achieves a decreased ink discharge amount per unit area by the line flushing, leading to enhanced ink drying characteristics.

EMBODIMENT 3

The following describes Embodiment 3 of the present invention with reference to drawings. Here, the description common to that of Embodiments 1 and 2 is to be omitted.

In Embodiment 2, the line flushing for various colors is performed, and simultaneously the printing start mark MA1 is printed, as illustrated in FIGS. 9A to 9C. At this time, the line flushing regions C, M, Y for ink other than black ink, i.e., for cyan, magenta and yellow ink, respectively, overlap the printing start mark MA1 with black ink to generate the overlap region K1. The overlap region K1 has poor drying characteristics. The ink is discharged to the overlap region K1 checkerwise for the line flushing. Consequently, a total ink discharge amount per unit area in the overlap region K1 can be decreased. This achieves enhanced ink drying characteristics.

In contrast to this, in Embodiment 3, the ink drying characteristics are much enhanced upon printing the printing start mark MA1.

Upon printing the printing start mark MA1, the controller 43 performs control to decrease an ink discharge amount per unit area in the overlap region K1 in the printing start mark MA1 with black ink to be smaller than that in the region K3 in the printing start mark MA1 except for the overlap region K1 and the line flushing region K2 with black ink (corresponding to the decreasing step in the present invention).

That is, in the overlap region K1 of the sections SC2 to SC4 in FIG. 9A, an ink discharge per unit area in the printing start mark MA1 with black ink is decreased to be smaller than that in the region K3 in the section SC5 of the printing start mark MA1. Here, the printing start mark MA1 in the sections SC2 to SC5 is printed with discharge waveform signals for normal printing.

The mark detector 39 sets in advance a density threshold for detection of the mark with the white and black solid printing image in the web paper WP. In the overlap region K1 of the sections SC2 to SC4, an ink discharge amount per unit area and a threshold are set such that the printing image in different colors has a value exceeding the threshold. The region K3 in the section SC5 of the printing start mark MA1 does not overlap with the regions for colors other than black. The region K3 is subjected to printing with black ink only. Consequently, in the region K3 in the section SC5, a sufficient ink discharge amount (density) per unit area is set so as not to prevent the mark detector 39 from detecting the printing start mark MA1.

With the present embodiment, the controller 43 performs control upon printing of the printing start mark MA1 to decrease the ink discharge amount per unit area in the overlap region K1 in the printing start mark MA1 to be smaller than that in the region K3 in the printing start mark MA1 except for the overlap region K1 and the line flushing region K2 with black ink. As a result, the overlap region can have a decreased ink discharge amount per unit area for the printing start mark MA1. Accordingly, both ink discharge amounts per unit area in the overlap region in the printable region of the printing start mark MA1 and for the line flushing can be decreased, leading to much enhanced ink drying characteristics in the overlap region.

In addition, the ink discharge amount per unit area in the overlap region K1 in the printing start mark MA1 with black ink is decreased to be smaller than that in the region K3 in the printing start mark MA1 except for the overlap region K1 and the line flushing region K2. On the other hand, the line flushing with ink other than black ink (i.e., cyan, magenta and yellow ink) is performed to the overlap region K1. As a result, although the density of the printing start mark MA1 in the overlap region K1 decreases, the density can be complemented to the extent that is required for detection of the mark.

The present invention is not limited to the foregoing examples, but may be modified as follows.

Figure 10:
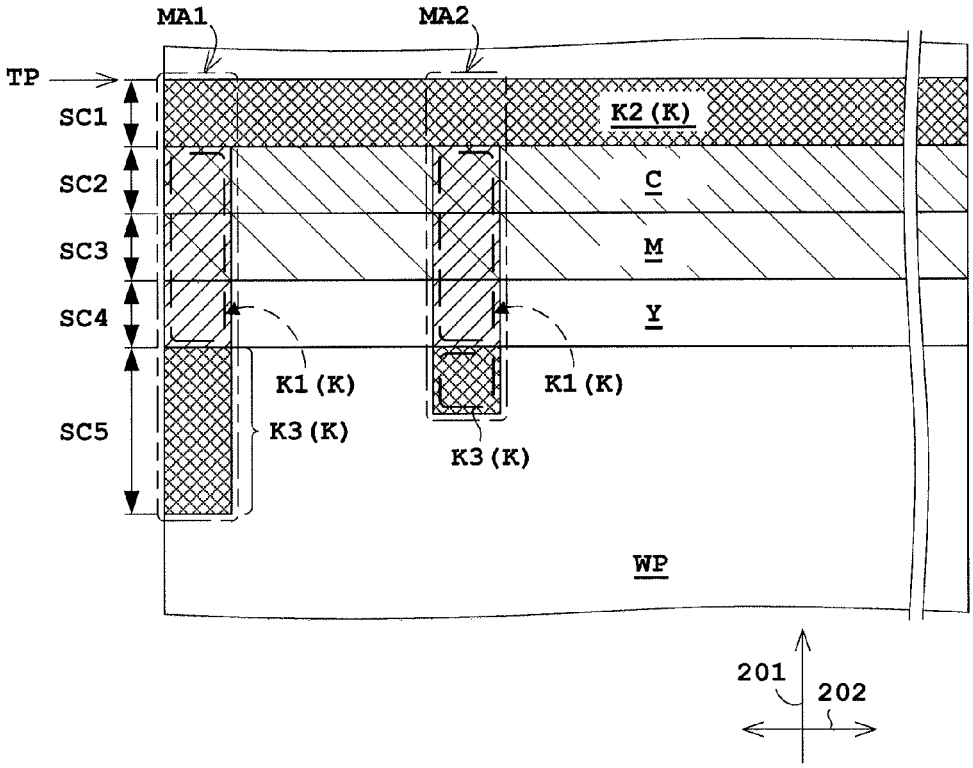
FIGS. 10 and 11 each illustrate a printable region of a cutter mark and a line flushing region according to one modification of the present invention.
Figure 11:
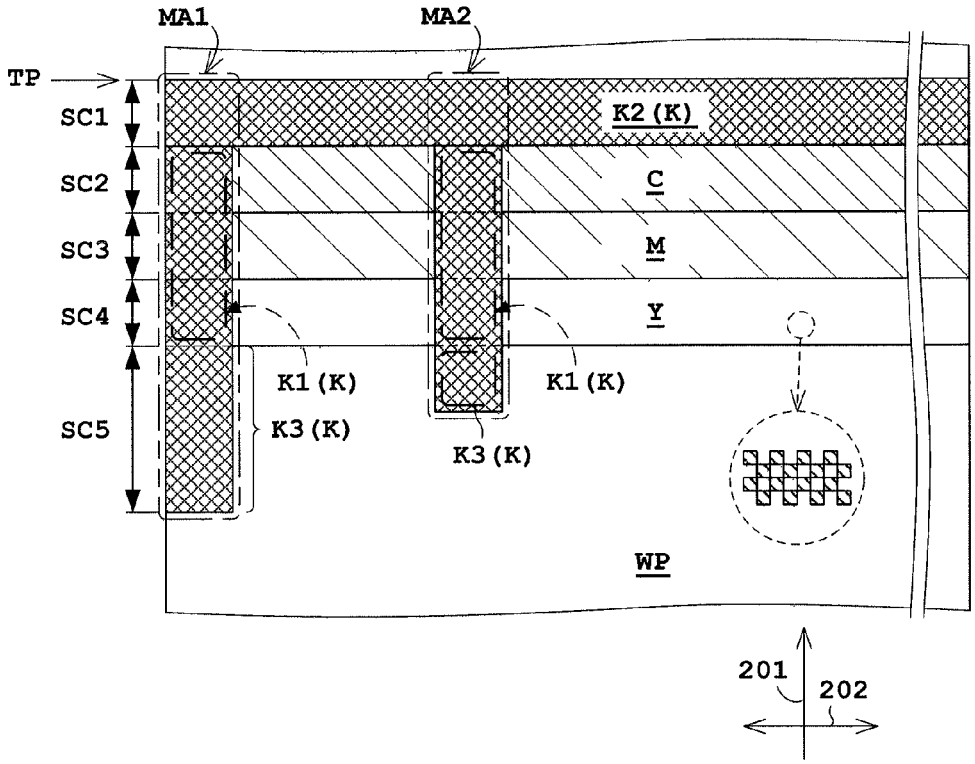

(1) In the present embodiment mentioned above, the printing start mark MA1 has been described as one example of the page top position mark representing information on the page top position of the web paper WP and printed from the page top position. However, this is not limitative. For instance, as illustrated in FIGS. 10 and 11, the page top position mark may be a cutter mark MA2 for a processing machine in the printing apparatus 1 that cuts the printed web paper WP. The cutter mark MA2 is disposed downstream of the page top position TP in the web paper WP except for both ends in the width direction 202 of the web paper WP.

When the overlap region is present in which the printable region to which the page top position mark is printed overlaps the line flushing region, enhanced ink drying characteristics are obtainable with the page top position mark containing the printing start mark MA1 and the cutter mark MA2. In FIG. 11, the printing start mark MA1 and the cutter mark MA2 are printed. However, the printing start mark MA1 is not necessarily printed.

(2) In the embodiment and the modification (1) mentioned above, the page top position mark containing the printing start mark MA1 and the cutter mark MA2 has been described as one example of the page information mark representing the page information on the web paper WP. However, this is not limitative. For instance, the mark that is not printed from the page top position may be used.

(3) In the embodiment and the modifications mentioned above, the front-face print unit 5 performs printing of the printing start mark MA1 and the cutter mark MA2 and performs the line flushing. Alternatively, the rear-face print unit 9 may perform at least either printing of the cutter mark MA2 or the line flushing.

(4) In the embodiment and the modifications mentioned above, the printing start mark MA1 is printed with black ink. Alternatively, the printing start mark MA1 may be printed with ink other than black ink as long as it is detectable by the mark detector 39. Consequently, when the overlap region K1 is present in with the printing start mark MA1 printed with ink other than black ink overlaps the line flushing region, enhanced ink drying characteristics are obtainable.

(5) In the embodiment and the modifications mentioned above, all the inkjet nozzles 41 discharge the ink in the line flushing step. In contrast to this, not all the provided inkjet nozzles 41 but all the inkjet nozzles 41 associated with the image printing may discharge ink.

As illustrated in FIGS. 3, 4A, and 4B, the printing heads 23 with a plurality of inkjet nozzles 41 may each be wider than the width of the web paper WP in the width direction 202. In this case, the inkjet nozzles 41 not used during the printing may not operate upon the line flushing as long as printing quality by the inkjet nozzles 41 used during the printing is not affected.

Consequently, the controller 43 controls the inkjet nozzles 41 required for maintaining the printing quality, i.e., all the inkjet nozzles 41 associated with the image printing, to discharge ink to the web paper WP for performing the line flushing. In other words, the controller 43 performs the line flushing without using the inkjet nozzles 41 disposed in a width W2 outside the width of the web paper WP or outside the pre-set width W1 containing the width of the web paper WP. At this time, the controller 43 may organize the inkjet nozzles 41 associated with the image printing into groups.

(6) In the embodiment and the modifications mentioned above, the printing heads 23 each includes a plurality of inkjet nozzles 41 as in FIGS. 3, 4A, and 4B. The inkjet nozzles are disposed over the width direction 202 of the web paper WP in a length more than a width of the web paper WP. Alternatively, the inkjet nozzles 41 may be arranged in a length less than the width of the web paper WP.

(7) In the embodiment and the modifications mentioned above, one of the two groups GR1 and GR2 discharges ink successively at a given timing in FIG. 6B. Alternatively, the following may be adopted. That is, all the groups GR1 and GR2 discharge no ink at least one time at a timing in FIG. 6B between the first group GR1 and the second group GR2, for example, or while ink is discharged two times successively in the transportation direction 201 of the first group GR1 in FIG. 7B.

(8) In the embodiment and the modifications mentioned above, the web paper WP is made of paper. Alternatively, the web paper WP may be made a resin sheet.

The present invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing method of printing an image by controlling printing heads with a controller to discharge ink to a print medium to be transported, the printing heads having a plurality of inkjet nozzles for discharging the ink being disposed in parallel in a width direction intersecting a transportation direction of the print medium, the inkjet printing method comprising:

a line flushing step of performing line flushing to the print medium to be transported in which all of the inkjet nozzles associated with printing of the image discharge the ink individually, wherein the line flushing step comprises:

an ink discharge step of discharging the ink to the print medium to be transported at least one time with any one of two or more groups into which the inkjet nozzles are organized;

a group switching step of switching the one group to the other group while the ink discharge step is performed when the ink is discharged a pre-set number of times to the print medium to be transported;

an at least one round taking step of taking at least one round of discharging the ink in the ink discharge step and discharging the ink from the groups in the group switching step; and further comprising:

a mark printing step of printing a page information mark onto the print medium to be transported along with the line flushing, the page information mark representing page information on the print medium, wherein the page information mark is printed such that an overlap region is present in which a printable region of the page information mark with pre-set color ink overlaps a line flushing region with ink other than the pre-set color ink.

2. The inkjet printing method according to claim 1, wherein the inkjet nozzles in the groups are each disposed at one or plural intervals.

3. The inkjet printing method according to claim 1, wherein the mark printing step comprises an decreasing step of decreasing an ink discharge amount per unit area in the overlap region in the printable region of the page information mark with the pre-set color ink to be smaller than that in the printable region of the page information mark except for the overlap region and the line flushing region.

4. An inkjet printing apparatus discharging ink to a print medium to be transported to print an image, the inkjet printing apparatus comprising:

printing heads each having a plurality of inkjet nozzles for discharging the ink being disposed in parallel in a width direction intersecting a transportation direction of the print medium; and a controller controlling the printing heads, wherein the controller controls all of the inkjet nozzles associated with printing of the image to discharge the ink to the print medium to perform line flushing, and upon performing the line flushing, the controller performs control to discharge the ink individually to the print medium to be transported at least one time with any one of two or more groups into which the inkjet nozzles are organized; performs control to switch the one group to the other group when the ink is discharged a pre-set number of times to the print medium to be transported and to take at least one round of discharging the ink with the groups; and performs control to print a page information mark onto the print medium to be transported along with the line flushing, the page information mark representing page information on the print medium, wherein the page information mark is printed such that an overlap region is present in which a printable region of the page information mark with pre-set color ink overlaps a line flushing region with ink other than the pre-set color ink.

5. The inkjet printing apparatus according to claim 4, wherein the inkjet nozzles in the groups are each disposed at one or plural intervals.

6. The inkjet printing apparatus according to claim 4, wherein the controller performs control to decrease an ink discharge amount per unit area in the overlap region in the printable region of the page information mark with the pre-set color ink to be smaller than that in the printable region of the page information mark except for the overlap region and the line flushing region.

* * * * *